US009747843B2

(12) United States Patent
Na et al.

(10) Patent No.: US 9,747,843 B2
(45) Date of Patent: Aug. 29, 2017

(54) DISPLAY APPARATUS HAVING DE-MULTIPLEXER AND DRIVING METHOD THEREOF

(71) Applicant: SAMSUNG DISPLAY CO., LTD., Yongin, Gyeonggi-Do (KR)

(72) Inventors: Jisu Na, Yongin (KR); Seungkyu Lee, Yongin (KR); Taehoon Kim, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/745,891

(22) Filed: Jun. 22, 2015

(65) Prior Publication Data

US 2016/0210904 A1 Jul. 21, 2016

(30) Foreign Application Priority Data

Jan. 15, 2015 (KR) ..... 10-2015-0007446

(51) Int. Cl.
*G09G 3/32* (2016.01)
*G09G 3/3291* (2016.01)

(52) U.S. Cl.
CPC ... *G09G 3/3291* (2013.01); *G09G 2300/0819* (2013.01); *G09G 2300/0861* (2013.01); *G09G 2310/0251* (2013.01); *G09G 2310/0297* (2013.01)

(58) Field of Classification Search
CPC ..... G09G 3/32–3/3291; G09G 2300/0809; G09G 2300/0814; G09G 2310/0248; G09G 2310/0251; G09G 2310/0264; G09G 2310/0297; G09G 2310/061–2310/065
See application file for complete search history.

(56) References Cited

U.S. PATENT DOCUMENTS

2002/0047820 A1* 4/2002 Ha ..... G09G 3/3648 345/87
2003/0151564 A1* 8/2003 Yamashita ..... G09G 3/3648 345/52
2006/0125738 A1 6/2006 Kim et al.
2008/0170008 A1 7/2008 Kim
2013/0222356 A1 8/2013 Jeong et al.
2014/0347347 A1 11/2014 Jeong et al.

FOREIGN PATENT DOCUMENTS

KR 10-2006-0000929 A 1/2006
KR 10-2006-0053754 5/2006
KR 10-2008-0067488 7/2008
KR 10-2013-0098613 9/2013
KR 10-2014-0137504 12/2014

* cited by examiner

*Primary Examiner* — Nathan Danielsen
(74) *Attorney, Agent, or Firm* — Lee & Morse P.C.

(57) ABSTRACT

A display apparatus includes a de-multiplexer having a number of first switches equal to a number of data lines. Each of the first switches is connected to a first end of a corresponding one of the data lines. The display apparatus also includes a plurality of switch circuits. Each switch circuit includes a plurality of second switches. Each the second switches are substantially in parallel and are connected to a second end of a corresponding one of the data lines.

19 Claims, 9 Drawing Sheets

DISPLAY APPARATUS HAVING DE-MULTIPLEXER AND DRIVING METHOD THEREOF

CROSS-REFERENCE TO RELATED APPLICATION

Korean Patent Application No. 10-2015-0007446, filed on Jan. 15, 2015, and entitled, "Display Apparatus and Driving Method Thereof," is incorporated by reference herein in its entirety.

BACKGROUND

1. Field

One or more embodiments described herein relate to a display apparatus and a method for driving a display apparatus.

2. Description of the Related Art

An organic light-emitting display apparatus uses a plurality of self-emissive devices to generate an image. Self emissive devices such as organic light-emitting diodes (OLEDs) have excellent brightness and generate images with color purity. The OLEDs are controlled, in part, by a data driver, which has a number of output lines equal to the number of data lines. Manufacturing costs increase as the number of integrated circuits implementing the data driver and other control circuits increase.

SUMMARY

In accordance with one or more embodiments, a display apparatus includes a plurality of data lines, a de-multiplexer including a number of first switches equal to a number of the data lines, each of the first switches connected to a corresponding one of the data lines; and a plurality of switch circuits, each of the switch circuits including a plurality of second switches, each the second switches substantially in parallel and connected to a corresponding one of the data lines. A number of the second switches in each of the switch circuits may be less than the number of the first switches in the de-multiplexer.

The display apparatus may include a data driver connected to an output line, wherein the data driver is to transmit data signals to the output line connected to the de-multiplexer. The display apparatus may include a plurality of control lines connected to the first switches and the second switches. Each of the second switches may be connected to one of the control lines different from a control line connected to the first switch connected to a corresponding one of the data lines. The display apparatus may include a scan driver connected to a plurality of scan lines; and a plurality of pixels connected to the scan lines and the data lines, wherein the scan driver is to transmit scan signals to the scan lines that overlap control signals to be transmitted to the control lines.

The first switches in the de-multiplexer may be turned on in a fixed order, and when one of the first switches is turned on, one of the second switches may be turned on, the turned-on second switch connected to a corresponding one of the data lines. The display apparatus may include a scan driver connected to a plurality of scan lines; and a plurality of pixels connected to the scan lines and the data lines, wherein the scan driver is to transmit scan signals to the scan lines to overlap control signals to be transmitted to the control lines. A black signal may be transmitted to a corresponding one of the data lines via the second switch that is turned on.

In accordance with one or more other embodiments, a display apparatus includes a pixel connected to a scan line and a data line; a first switch connected to the data line; a plurality of second switches substantially in parallel and connected to the data line; a data driver to transmit a data signal to an output line connected to the first switch; and a scan driver to transmit a scan signal to the scan line. The first switch may be turned on in one sub frame of a plurality of sub frames in a frame, and each of the second switches may be turned on in another sub frame. The first switch may transmit the data signal to the pixel via the data line, and the second switches may transmit a black signal to the pixel via the data line. The display apparatus may include a plurality of control lines connected to the first switch and the second switches. The scan signal may be transmitted in each of a plurality of sub frames in a frame, and a control signal may overlap the scan signal in each sub frame and is to be transmitted to one of the control lines.

In accordance with one or more other embodiments, a method for driving a display apparatus includes transmitting a first scan signal to a scan line in each of a plurality of sub frames in a frame; transmitting a data signal to a data line in synchronization with the first scan signal in one of the sub frames; and transmitting a black signal to the data line in synchronization with the first scan signal in another one of the sub frames.

Transmitting the data signal may include transmitting the data signal to the data line when a plurality of first switches connected to an output line of a data driver are turned on by control signals in a fixed order. The control signal may overlap the first scan signal. Transmitting the black signal may include transmitting the black signal to the data line when the second switches are turned on by the control signals in a fixed order. The control signal may overlap the first scan signal. The method may include transmitting a second scan signal to the scan line in each sub frame; and transmitting initialization signal to the pixel in synchronization with the second scan signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
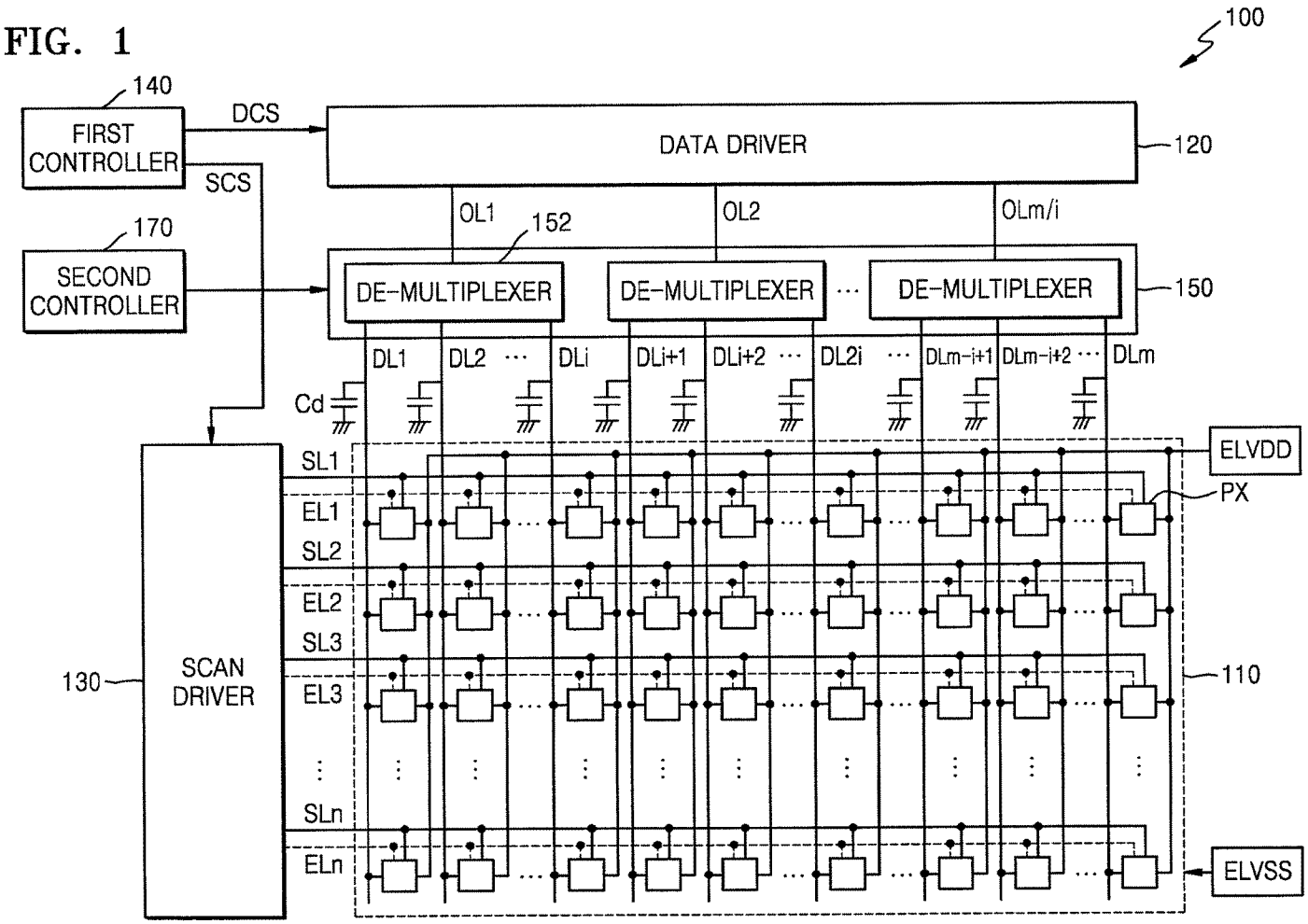
FIG. 1 illustrates an embodiment of a display apparatus.

Example embodiments are described more fully with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of a display apparatus 100 which includes a pixel unit 110, a data driver 120, a scan driver 130, a first controller 140, a data distribution unit 150, and a second controller 170. The display apparatus 100 may be, for example, an organic light-emitting display apparatus.

The pixel unit 110 includes a plurality of scan lines SL1 to SLn, a plurality of data lines DL1 to DLm, a plurality of emission control lines EL1 to ELn, a first power voltage line, and a plurality of pixels PXs. The scan lines SL1 to SLn are separated from each other at regular intervals, are arranged in a row direction, and respectively transmit scan signals to pixels PXs. The data lines DL1 to DLm are separated from each other at regular intervals, are arranged in a column direction, and respectively transmit data signals to pixels PXs. The scan lines SL1 to SLn and the data lines DL1 to DLm are arranged in a matrix form. The pixels PXs are formed at areas where the scan lines SL1 to SLn cross the data lines DL1 to DLm. The emission control lines EL1 to ELn respectively transmit emission control signals. The first power voltage line transmits a first power voltage ELVDD.

The data driver 120 is connected to a plurality of output lines OL1 to OLm/i, and the output lines OL1 to OLm/i are connected to the data lines DL1 to DLm via the data distribution unit 150. The data driver 120 converts image signals into data signals, which are in a voltage or current form, according to data driving control signals DCS by the first controller 140.

The scan driver 130 is connected to the scan lines SL1 to SLn, generates scan signals according to scan driving control signals SCS input by the first controller 140, and provides the generated scan signals to the scan lines SL1 to SLn. The scan driver 130 is connected to the emission control lines EL1 to ELn, generates emission control signals according to the scan driving control signals SCS, and provides the generated emission control signals to the emission control lines EL1 to ELn. According to the present exemplary embodiment, the scan driver 130 generates the emission control signals and provides the generated emission control signals to the pixel unit 110. In another embodiment, the emission control signals may be generated and provided to the pixel unit 110 using a separate drive, e.g., a separate emission control driver.

The first controller 140 corresponds to synchronization signals provided from an external source and generates the data driving control signals DCS and the scan driving control signals SCS. The first controller 140 outputs the data driving control signals DCS to data driver 120 and outputs the scan driving control signals SCS to scan driver 140.

The data distribution unit 150 is connected to the output lines OL1 to OLm/i and the data lines DL1 to DLm. The data distribution unit 150 may include m/i de-multiplexers 152 (e.g., i is a natural number equal to or greater than 2) including a plurality of switching devices. For example, the data distribution unit 150 may include a number of de-multiplexers 152 equal to the number of output lines (OL1 to OLm/i). An end portion of each de-multiplexer 152 is connected to one of the output lines OL1 to OLm/i. The other portion of each de-multiplexer 152 is connected to i data lines. The de-multiplexers 152 provide data signals from one of the output lines OL1 to OLm/i to i data lines. The number of output lines of the data driver 120 are less than the number of data lines because of the de-multiplexers 152. Thus the number of integrated circuits in or corresponding to the data driver 120 may be reduced, which may translate into a decrease in manufacturing costs.

The second controller 170 outputs i control signals to each de-multiplexer 152 in order to separately provide i data signals, which are provided to the output lines OL1 to OLm/i, to i data lines. The i control signals are sequentially output so that they do not overlap each other. In the present exemplary embodiment, the second controller 170 and the first controller 140 are separately included. In another embodiment, the second controller 170 may be in the first controller 140.

A data capacitor Cd is in each data line. The data capacitor Cd temporarily stores data signals provided to the data lines and provides the stored data signals to the pixels PXs. The data capacitor Cd here may be a parasitic capacitor that is equivalently formed in the data lines. Also, capacitors may be additionally formed in each data line and may be used as a data capacitor Cd.

Figure 2:
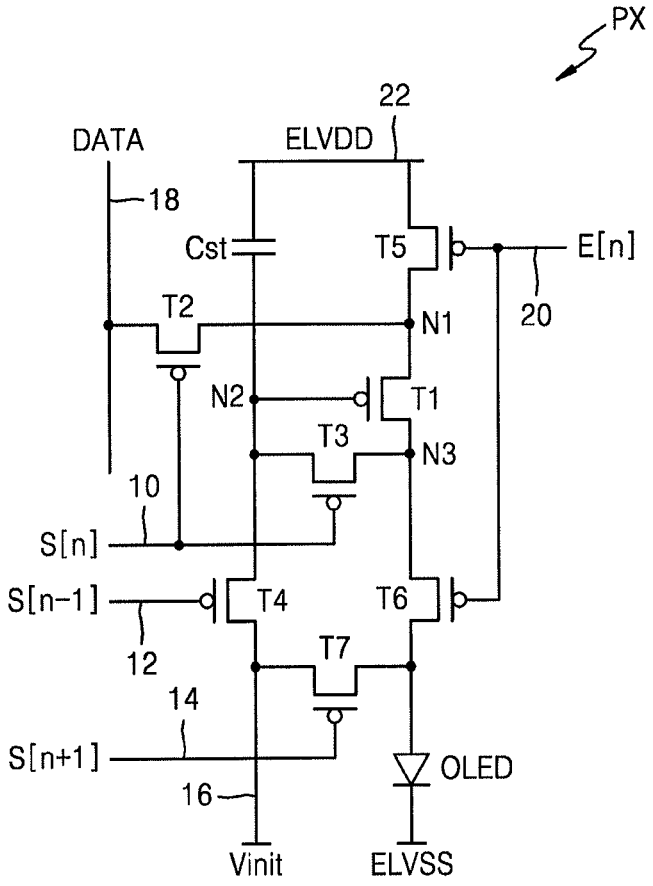
FIG. 2 illustrates an embodiment of a pixel.

FIG. 2 illustrates an embodiment of a pixel PX which includes a plurality of transistors T1 to T7, a capacitor Cst, and an emission device. The emission device may be an organic light-emitting diode (OLED).

The first transistor T1 includes a gate electrode connected to a first electrode of the capacitor Cst, the first electrode connected to a first node N1, and a second electrode connected to a third node N3. The first transistor T1 functions as a driving transistor and provides a current to the OLED based on a data signal DATA received according to a switching operation of the second transistor T2.

The second transistor T2 includes a gate electrode connected to a first scan line 10, a first electrode connected to a data line 18, and a second electrode connected to the first electrode of the first transistor T1 at the first node N1. The second transistor T2 is turned on according to a first scan signal S[n] transmitted via the first scan line 10 and performs a switching operation of transmitting, to the first electrode of the first transistor T1, the data signals DATA transmitted to the data lines.

The third transistor T3 includes the gate electrode connected to the first scan line 10, a first electrode connected to the second electrode of the first transistor T1 at the third node N3, and a second electrode connected to the first electrode of the capacitor Cst, a second electrode of the fourth transistor T4, and the gate electrode of the first transistor T1 at a second node N2. The third transistor T3 is turned on according to a first scan signal S[n] transmitted via the first scan line 10 and diode-connects the first transistor T1.

The fourth transistor T4 includes a gate electrode connected to a second scan line 12, a first electrode connected to an initial voltage line 16, and a second electrode connected to the first electrode of the capacitor Cst, the second electrode of the third transistor T3, and the gate electrode of the first transistor T1 at the second node N2. The first electrode and the second electrode of the fourth transistor T4 may be a source electrode and a drain electrode according to the direction of current. The fourth transistor T4 is turned on according to the second scan signal S[n−1] transmitted via the second scan line 12, transmits an initial voltage Vinit to the gate electrode of the first transistor T1, and performs an operation of initializing a voltage of the gate electrode of the first transistor T1.

The fifth transistor T5 includes a gate electrode connected to an emission control line 20, a first electrode connected to a first power voltage line 22, and a second electrode connected to the first electrode of the first transistor T1 and the second electrode of the second transistor T2 at the first node N1.

The sixth transistor T6 includes the gate electrode connected to the emission control line 20, a first electrode connected to the second electrode of the first transistor T1 and the first electrode of the third transistor T3 at the third node N3, and a second electrode connected to an anode of the OLED.

The fifth transistor 15 and the sixth transistor T6 are simultaneously turned on according to an emission control signal E[n] transmitted via the emission control line 20, and the first power voltage ELVDD is transmitted to the OLED. As a result, a current flows in the OLED.

The seventh transistor T7 includes a gate electrode connected to a third scan line 14, a first electrode connected to the second electrode of the sixth transistor T6 and the anode of the OLED, and a second electrode connected to the initial voltage line 16. The first electrode and the second electrode of the seventh transistor T7 become a source electrode and a drain electrode according to a direction of a current. The seventh transistor T7 is turned on according to a third scan signal S[n+1] transmitted via the third scan line 14, transmits the initial voltage Vinit to the anode of the OLED, and performs an operation of initializing a voltage of the anode of the OLED.

The capacitor Cst includes a first electrode connected to the gate electrode of the first transistor T1, the second electrode of the third transistor T3, and the second electrode of the fourth transistor T4 at the second node N2, and a second electrode connected to the first power voltage line 22.

A cathode of the OLED is connected to a second power source providing a second power voltage ELVSS.

In the present exemplary embodiment, the third scan line 14 is connected to the gate electrode of the seventh transistor T7, and the third scan signal S[n+1] is transmitted to the third scan line 14. In another embodiment, the first scan line 10 or the second scan line 12 is connected to the gate electrode of the seventh transistor 17, and the first scan signal S[n] or the second scan signal S[n−1] may be transmitted to the gate electrode of the seventh transistor T7.

Figure 3:
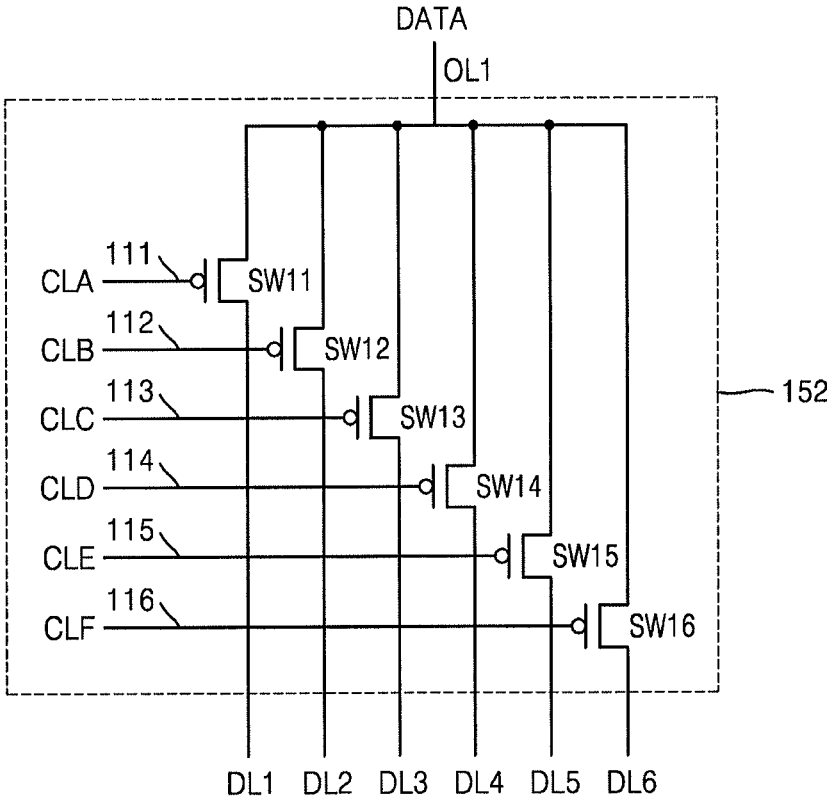
FIG. 3 illustrates an embodiment of a de-multiplexer.
Figure 4:
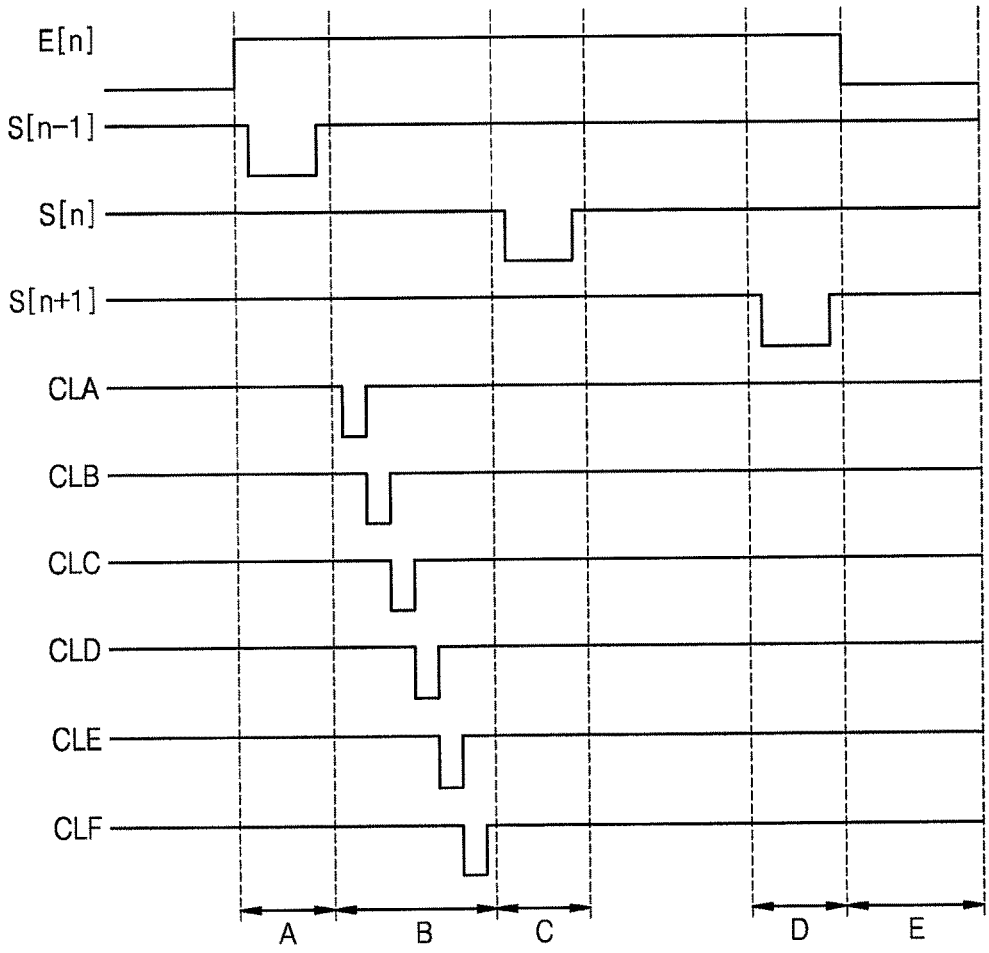
FIG. 4 illustrates an embodiment of a method for driving a display apparatus.

FIG. 3 illustrates an embodiment of an internal circuit of the de-multiplexer 152, and FIG. 4 is a timing diagram of control signals corresponding to one embodiment of a method for driving a display apparatus. In FIG. 3, the de-multiplexer 152 is illustrated as connected to a first output line OL1 and first to sixth data lines DL1 to DL6 when i is 6, and the de-multiplexer 152 includes first to sixth switches SW11 to SW16.

The first switch SW11 is between the first output line OL1 and the first data line DL1. The first switch SW11 transmits the data signals DATA, which are transmitted to the first output line OL1, to the first data line DL1 according to a first control signal CLA transmitted from the first control line 111. The second switch SW12 is between the first output line OL1 and the second data line DL2. The second switch SW12 transmits the data signals DATA, which are transmitted to the first output line OL1, to a second data line DL2 based on a second control signal CLB from the second control line 112.

The third switch SW13 is between the first output line OL1 and the third data line DL3. The third switch SW13 transmits the data signals DATA, which are transmitted to the first output line OL1, to the third data line DL3 according to a third control signal CLC transmitted from the third control line 113.

The fourth switch SW14 is between the first output line OL1 and the fourth data line DL4. The fourth switch SW14 transmits the data signals DATA, which are transmitted to the first output line OL1, to the fourth data line DL4 according to a fourth control signal CLD transmitted from the fourth control line 114.

The fifth switch SW15 is between the first output line OL1 and the fifth data line DL5. The fifth switch SW15 transmits the data signals DATA, which are transmitted to the first output line OL1, to the fifth data line DL5 according to a fifth control signal CLE transmitted from the fifth control line 115.

The sixth switch SW16 is between the first output line OL1 and the sixth data line DL6. The sixth switch SW16 transmits the data signals DATA, which are transmitted to the first output line OL1, to the sixth data line DL6 according to a sixth control signal CLF transmitted from the sixth control line 116.

A method for driving the display apparatus 100 of FIG. 1 will now be described with reference to FIGS. 2 to 4. The pixels PXs of FIG. 2 are connected to the first to sixth data lines DL1 to DL6 of FIG. 3. For example, a first color pixel emitting a first color of light is connected to the first data line DL1 and the fourth data line DL4, a second color pixel emitting a second color of light is connected to the second data line DL2 and the fifth data line DL5, and a third color pixel emitting a third color of light is connected to the third data line DL3 and the sixth data line DL6.

During a first period A, the gate electrode of the first transistor T1, which is included in each of the pixels PXs connected to the first to sixth data lines DL1 to DL6, is initialized. Each pixel PX receives the second scan signal S[n−1] having a gate-on voltage (e.g., a low level) via the second scan line 12, and the fourth transistor T4 is turned on in accordance with the reception of the second scan signal S[n−1]. The initial voltage Vinit is applied to the gate electrode of the first transistor T1 via the fourth transistor T4. Thus, the gate electrode of the first transistor T1 and the capacitor Cst are initialized.

During a second period B, the first to sixth data lines DL1 to DL6 are pre-charged. During the second period B, the first to sixth control signals CLA to CLF are sequentially input to the first to sixth control lines 111 to 116. Accordingly, the first to sixth switches SW11 to SW16 are sequentially turned on, and the data signals DATA are sequentially transmitted to first to sixth data lines DL1 to DL6. In this case, voltages corresponding to the transmitted data signals DATA are charged in the data capacitors Cds respectively included in the first to sixth data lines DL1 to DL6. Since the scan signals are not transmitted to pixels during the second period B, the data signals DATA are not transmitted to the pixels PXs connected to the first to sixth data lines DL1 to DL6.

During a third period C, the data signals DATA are input to each pixel PX. Each pixel PX receives the first scanning signal S[n] having a gate-on voltage (a low level) via the first scan line 10, and the second transistor T2 and the third transistor T3 are turned on in accordance with the reception of the first scanning signal S[n]. The data signals DATA stored in the data capacitor Cd are transmitted to the first node N1 via the second transistor T2. The first transistor T1 is diode-connected via the third transistor T3 that is turned on and is biased in a forward direction, and a compensation voltage DATA+Vth (where Vth is a negative (−) value) that is decreased by a threshold voltage Vth of the first transistor T1 is applied to the gate electrode of the first transistor T1. The first power voltage ELVDD and the compensation voltage DATA+Vth are applied to both ends of the capacitor Cst, and electric charges corresponding to a voltage difference between the ends of the capacitor Cst are stored in the capacitor Cst.

During a fourth period D, the anode of the OLED is initialized. Each pixel PX receives the third scan signal S[n+1] having a gate-on voltage (a low level) via the third scan line 14, and the seventh transistor T7 is turned on in accordance with the reception of the third scan signal S[n+1]. The initial voltage Vinit is applied to the anode of the OLED via the seventh transistor T7, and the anode of the OLED is initialized. During a fifth period E, the OLED emits light. A voltage of the emission control signal E[n] is changed from a gate-off voltage (e.g., a high level) to a gate-on voltage (a low level) via the emission control line 20 of each pixel PX. Accordingly, the fifth transistor T5 and the sixth transistor T6 are turned on. A current corresponding to a difference between a voltage of the gate electrode of the first transistor T1 and the first power voltage ELVDD is generated and provided to the OLED via the sixth transistor T6.

Figure 5:
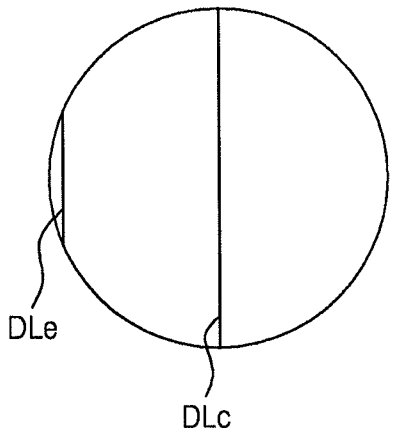
FIG. 5 illustrates an example of a parasitic capacitance in a circular display.

In the present embodiment, the data signals DATA are pre-charged using the data capacitor Cd of the data lines. Then, the pre-charged data signals DATA are transmitted to the pixels PXs. As shown in FIG. 5, when the display apparatus is a circular display apparatus, capacitances of the data capacitors Cds of the data lines may be different. For example, the capacitance of a data capacitor Cd of a data line DLc, which is arranged at a central portion of a pixel unit, may be greater than the capacitance of a data capacitor Cd of a data line DLe arranged on an edge portion of the pixel unit. Accordingly, a brightness deviation may occur.

Figure 6:
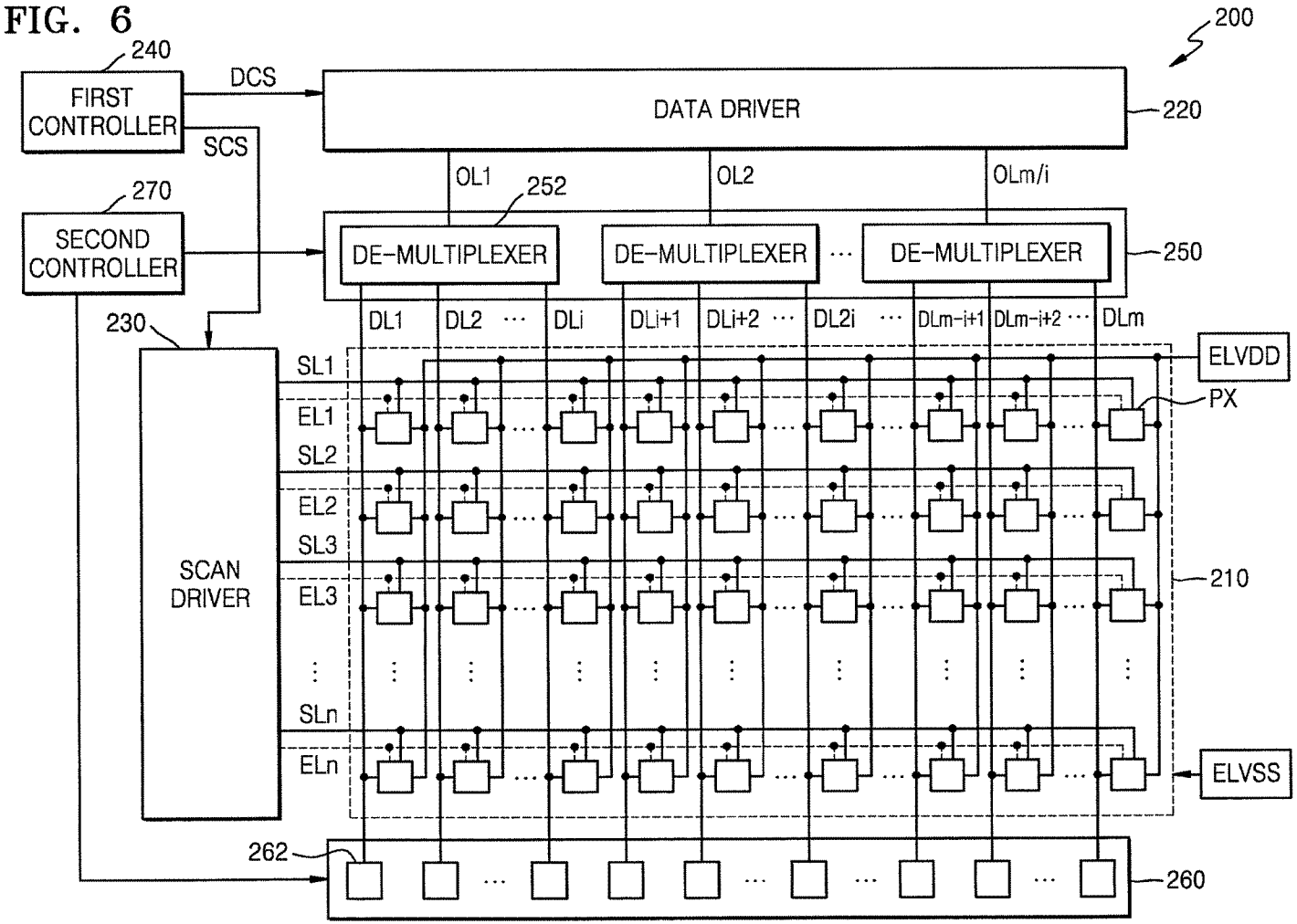
FIG. 6 schematically another embodiment of a display apparatus.

FIG. 6 illustrates another embodiment of a display apparatus 200 which includes a pixel unit 210, a data driver 220, a scan driver 230, a first controller 240, a data distribution unit 250, a black insertion unit 260, and a second controller 270. The display apparatus 200 may be an organic light-emitting display apparatus.

The pixel unit 210 includes scan lines SL1 to SLn, data lines DL1 to DLm, emission control lines EL1 to ELn, a first power voltage line, and pixels PXs. The scan lines SL1 to SLn are separated from each other at regular intervals, are arranged in a row direction, and transmit scanning signals. The data lines DL1 to DLm are separated from each other at regular intervals, are arranged in a column direction, and transmit data signals. The scan lines SL1 to SLn and the data lines DL1 to DLm are arranged in a matrix form. The pixels PXs are formed in an area where the scan lines SL1 to SLn and the data lines DL1 to DLm cross each other. The emission control lines EL1 to ELn respectively transmit emission control signals. The first power voltage line transmits a first power voltage ELVDD. Each pixel PX may have a structure as illustrated in FIG. 2.

The data driver 220 is connected to output lines OL1 to OLm/i, and each of the output lines OL1 to OLm/i are connected to an end of each of the data lines DL1 to DLm via the data distribution unit 250. The data driver 220 converts image signals to data signals which are in a voltage or current form and transmits the data signals to the pixel unit 210 according to data driving control signals DCS input by the first controller 240.

The scan driver 230 is connected to the scan lines SL1 to SLn, generates scan signals according to the scan driving control signals SCS input by the first controller 240, and transmits the generated scan signals to the scan lines SL1 to SLn. The scan driver 230 is connected to the emission control lines EL1 to ELn, generates emission control signals according to the scan driving control signals SCS, and transmits the generated emission control signals to the emission control lines EL1 to ELn. In the present exemplary embodiment, the scan driver 230 generates and transmits the emission control signals to the pixel unit 210. In another embodiment, a separate emission control driving unit may generate and transmit the emission control signals to the pixel unit 210.

The first controller 240 generates the data driving control signals DCS and the scan driving control signals SCS in response to synchronization signals transmitted from an external source. The first controller 240 outputs the data driving control signals DCS to data driver 220 and outputs the scan driving control signals SCS to scan driver 230.

The data distribution unit 250 is connected to an end of each of the output lines OL1 to OLm/i and the data lines DL1 to DLm. The data distribution unit 250 may include m/i (where i is a natural number greater than 2) de-multiplexers 252 including a plurality of switching devices. For example, the data distribution unit 250 include a number of de-multiplexers 252 equal to the number of the output lines OL1 to OLm/i. An end of each de-multiplexer 252 is connected to one of the output lines OL1 to OLm/i. The other end of each de-multiplexer 252 is connected to i data lines. The de-multiplexer 252 includes i switching devices.

The de-multiplexer 252 transmits data signals, which are transmitted by one output line, to i data lines according to i control signals input by the second controller 270. Since the number of output lines OL1 to OLm/i of the data driver 220 is less than the number of the data lines DL1 to DLm because of the de-multiplexers 252, the number of output lines OL1 to OLm/i connected to the data driver 220 and the number of integrated circuits in or corresponding to the data driver 220 may be reduced, thereby decreasing manufacturing costs.

The black insertion unit 260 is connected to ends of the data lines DL1 to DLm. The black insertion unit 260 may include m switch units 262 in which a plurality of switching devices are arranged in parallel. For example, the black insertion unit 260 may include a number of switch units 262 equal to the number of data lines. Each of the switch units 262 is connected to one of the data lines DL1 to DLm. The switch unit 262 includes (i−1) switching devices arranged in parallel. Each switch unit 262 transmits black signals (or black grayscale signals) to a corresponding one of the data lines DL1 to DLm according to (i−1) control signals input by the second controller 270. The black signals are transmitted to the data lines during sub frames in which data signals are not transmitted. The second controller 270 outputs i control signals to respective de-multiplexers 252 in order to distribute and output i data signals to i data lines.

The i control signals are sequentially output in respective sub frames in order not to overlap each other. The second controller 270 outputs the (i−1) control signals to the switch units 262 in order to provide black signals to the data lines to which the data signals DATA are not transmitted. In the present exemplary embodiment, the second controller 270 is separated from the first controller 240. In another embodiment, the second controller 270 may be in the first controller 240.

One frame includes i sub frames. The number of sub frames forming one frame may be equal to the number of the control signals transmitted to the de-multiplexers 252 or the number of switching devices in the de-multiplexers 252.

The scan driver 230 transmits the scan signals in the sub frames to the scan lines according to the scan driving control signals SCS. The data driver 230 transmits the data signals DATA to the output lines in synchronization with the scan signals in respective sub frames, according to the data driving control signals DCS. The data distribution unit 250 transmits the data signals DATA to one of the data lines connected to the output lines in synchronization with the scan signals in respective sub frames, according to the control signals. The black insertion unit 260 transmits the black signals to the remaining data lines to which the data signals DATA are not transmitted in synchronization with the scan signals, according to the control signals. The control signals overlap the scan signals.

Figure 7A:
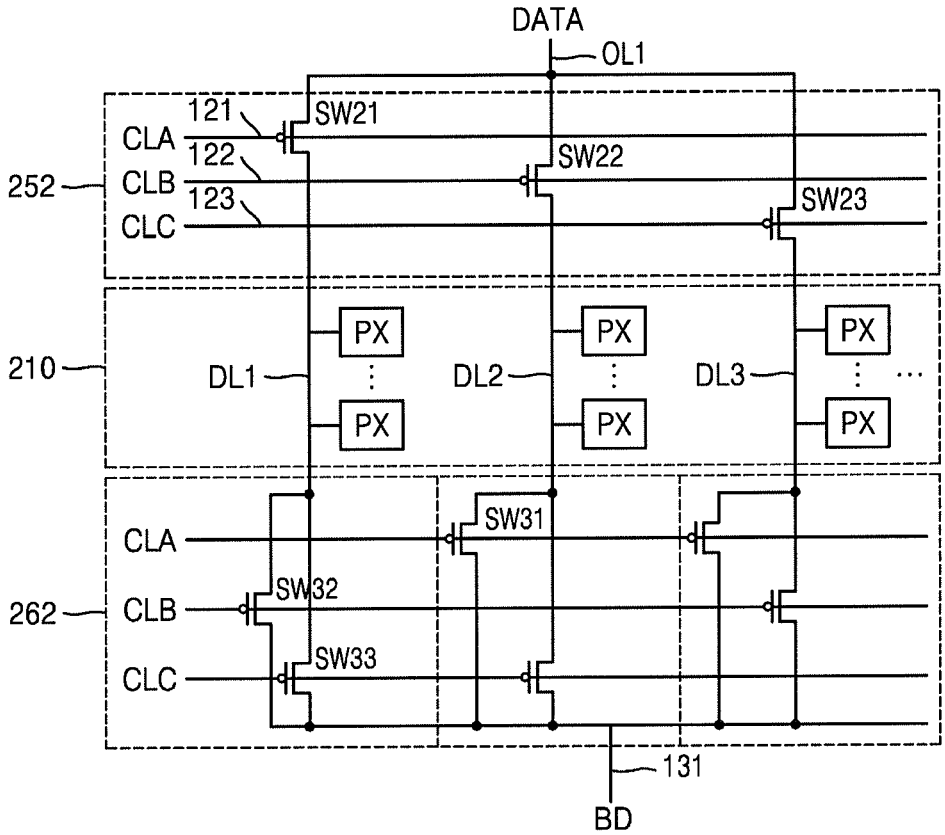
FIGS. 7A and 7B illustrate other embodiments of a de-multiplexer.
Figure 7B:
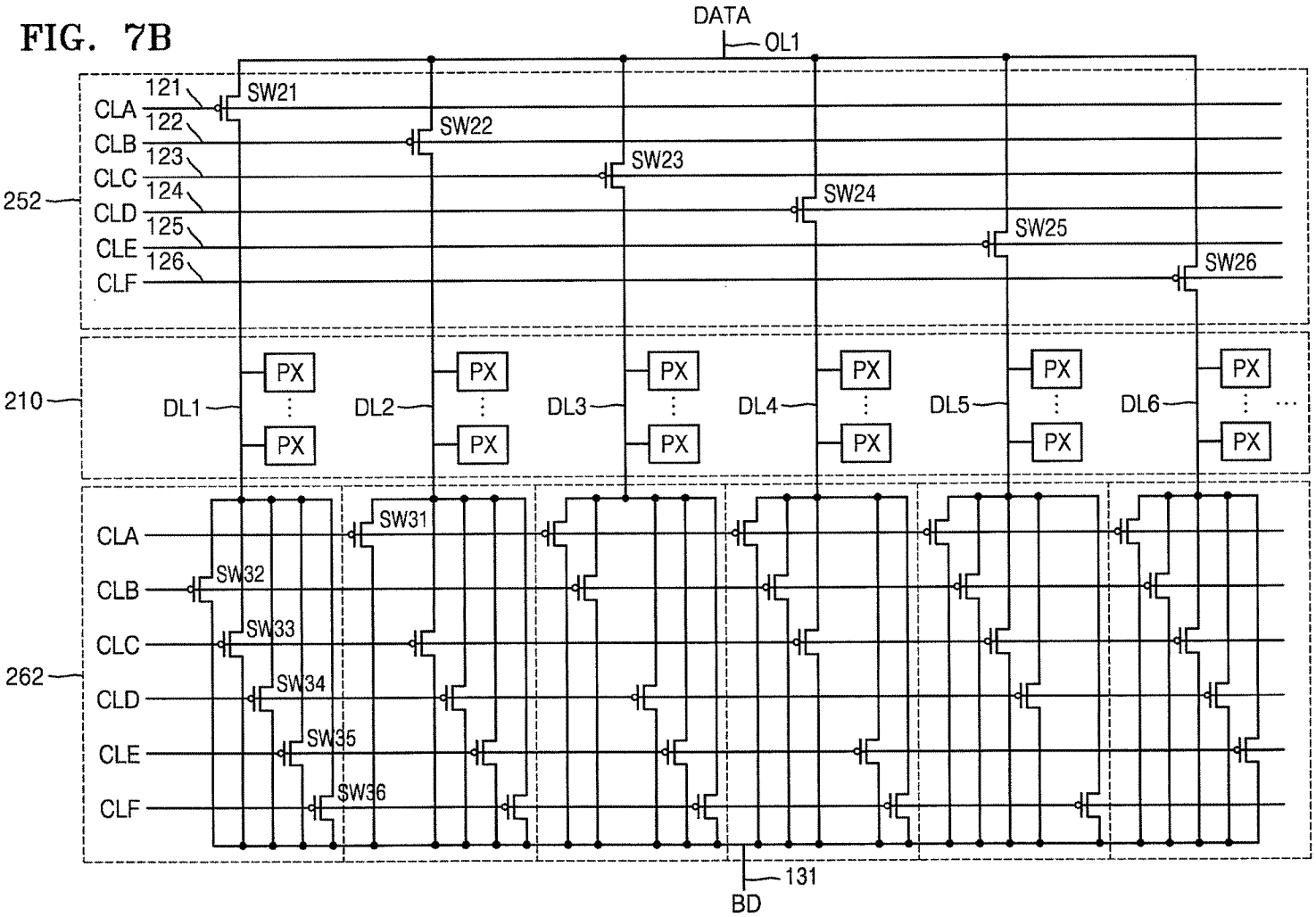
Figure 8:
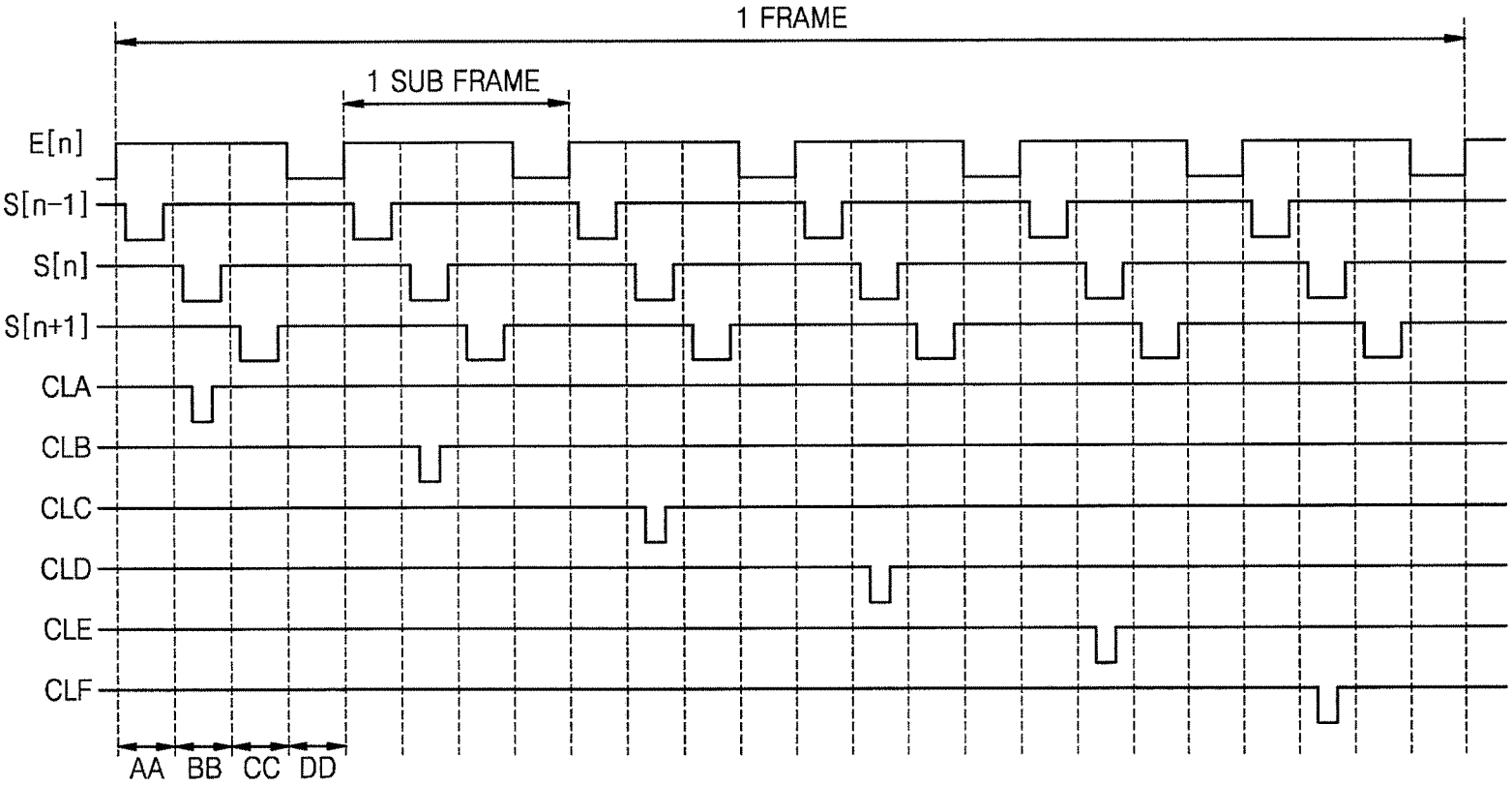
FIG. 8 illustrates another embodiment of a method for driving a display apparatus.

FIGS. 7A and 7B illustrate other embodiments of the de-multiplexer 252, and FIG. 8 is a timing diagram including control signals for one embodiment of a method for driving a display apparatus. In FIGS. 7A and 7B, only the data lines for the pixel unit 210 are illustrated for convenience.

FIG. 7A illustrates an embodiment of the de-multiplexer 252 and switch units 262 connected to a first output line OL1 and first to third data lines DL1 to DL3, when i is equal to 3. The de-multiplexer 252 is connected to ends of the data lines DL1 to DL3 of the pixel unit 210, and the switch units 262 are connected to the other end of each of the data lines DL1 to DL3. Pixels connected to the first data line DL1 may be first color pixels, pixels connected to the second data line DL2 may be second color pixels, and pixels connected to the third data line DL3 may be third color pixels.

The de-multiplexer 252 includes first to third distribution switches SW21 to SW23, which, for example, may be implemented as transistors. The first distribution switch SW 21 is between the first output line OL1 and the first data line DL1. The first distribution switch SW21 includes a gate connected to a first control line 121, a first terminal connected to the first output line OL1, and a second terminal connected to an end of the first data line DL1. The first distribution switch SW21 is turned on by a first control signal CLA transmitted by the first control line 121 and transmits data signals DATA, which are transmitted to the first output line OL1, to the first data line DL1.

The second distribution switch SW22 is between the first output line OL1 and the second data line DL2. The second distribution switch SW22 includes a gate connected to a second control line 122, a first terminal connected to the first output line OL1, and a second terminal connected to an end of the second data line DL2. The second distribution switch SW22 is turned on by a second control signal CLB transmitted by the second control line 122 and transmits the data signals DATA, which are transmitted to the first output line OL1, to the second data line DL2.

The third distribution switch SW23 is between the first output line OL1 and the third data line DL3. The third distribution switch SW23 includes a gate connected to a third control line 123, a first terminal connected to the first output line OL1, and a second terminal connected to an end of the third data line DL3. The third distribution switch SW23 is turned on by a third control signal CLC transmitted by the third control line 123 and transmits the data signals DATA, which are transmitted to the first output line OL1, to the third data line DL3.

The first to third control signals CLA to CLC are transmitted at different timings and thus do not overlap each other.

The switch units 262 are respectively connected to the first to third data lines DL1 to DL3. Each of the switch units 262 includes two control switches arranged in parallel. Each of the switch unit 262 includes two control switches receiving control signals other than control signals transmitted to the distribution switch connected to the corresponding data line.

The first distribution switch SW21 receiving the first control signal CLA is connected to an end of the first data line DL1. Accordingly, the switch unit 262 connected to the other end of the first data line DL1 includes a second control switch SW32 connected to the second control line 122 receiving the second control signal CLB and a third control switch SW33 connected to the third control line 123 receiving the third control signal CLC. The second control switch SW32 and the third control switch SW33 are between the first data line DL1 and a black signal input line 131. The second control signal SW32 is turned on by the second control signal CLB transmitted by the second control line 122 and transmits a black signal BD to the first data line DL1. The third control switch SW33 is turned on by the third control signal CLC transmitted by the third control line 123 and transmits the black signal BD to the first data line DL1.

The second distribution switch SW22 receiving the second control signal CLB is connected to an end of the second data line DL2. Accordingly, the switch unit 262 connected to the other end of the second data line DL2 includes a first control switch SW31 connected to the first control line 121 receiving the first control signal CLA and the third control switch SW33 connected to the third control line 123 receiving the third control signal CLC. The first control switch SW31 and the third control switch SW33 are between the second data line DL2 and the black signal input line 131. The first control switch SW31 is turned on by the first control signal CLA transmitted by the first control line 121 and transmits the black signal BD to the second data line DL2. The third control switch SW33 is turned on by the third control signal CLC transmitted by the third control line 123 and transmits the black signal BD to the second data line DL2.

The third distribution switch SW23 receiving the third control signal CLC is connected to an end of the third data line DL3. Accordingly, the switch unit 262 connected to the other end of the third data line DL3 includes the first control switch SW31 connected to the first control line 121 receiving the first control signal CLA, and the second control switch SW32 connected to the second control line 122 receiving the second control signal CLB. The first control switch SW31 and the second control switch SW32 are between the third data line DL3 and the black signal input line 131. The first control switch SW31 is turned on by the first control signal CLA transmitted by the first control line 121 and transmits the black signal BD to the third data line DL3. The second control switch SW32 is turned on by the second control signal CLB transmitted by the second control line 122 and transmits the black signal BD to the third data line DL3.

FIG. 7B illustrates another embodiment of the de-multiplexer 252 and the switch units 262 connected to the first output line OL1 and the first to sixth data lines DL1 to DL6. The de-multiplexer 252 is connected to ends of the data lines of the pixel unit 210, and the switch units 262 are connected to the other ends of the data lines of the pixel unit 210. Pixels connected to the first data line DL1 and the fourth data line DL4 may be first color pixels, pixels connected to the second data line DL2 and the fifth data line DL5 may be second color pixels, and pixels connected to the third data line DL3 and the sixth data line DL6 may be third color pixels.

The de-multiplexer 252 includes first to sixth distribution switches SW21 to SW26, which, for example, may be implemented as transistors.

In addition to the first to third distribution switches SW21 to SW23 in FIG. 7A, the de-multiplexer 252 of FIG. 7B includes the fourth to sixth distribution switches SW24 to SW26. The fourth distribution switch SW24 is between the first output line OL1 and the fourth data line DL4. The fourth distribution switch SW24 includes a gate connected to the fourth control line 124, a first terminal connected to the first output line OL1, and a second terminal connected to an end of the fourth data line DL4. The fourth distribution switch SW24 is turned on by the fourth control signal CLD transmitted by the fourth control line 124 and transmits the data signals DATA, which are transmitted to the first output line OL1, to the fourth data line DL4.

The fifth distribution switch SW25 is between the first output line OL1 and the fifth data line DL5. The fifth distribution switch SW25 includes a gate connected to the fifth control line 125, a first terminal connected to the first output line OL1, and a second terminal connected to an end of the fifth data line DL5. The fifth distribution switch SW25 is turned on by the fifth control signal CLE transmitted by the fifth control line 125 and transmits the data signals DATA, which are transmitted to the first output line OL1, to the fifth data line DL5.

The sixth distribution switch SW26 is disposed between the first output line OL1 and the sixth data line DL6. The sixth distribution switch SW26 includes a gate connected to the sixth control line 126, a first terminal connected to the first output line OL1, and a second terminal connected to an end of the sixth data line DL6. The sixth distribution switch SW26 is turned on by the sixth control signal CLF transmitted by the sixth control line 126 and transmits the data signals DATA, which are transmitted to the first output line OL1, to the sixth data line DL6.

The first to sixth control signals CLA to CLF are transmitted at different timings and thus do not overlap each other.

The switch units 262 are respectively connected to the first to sixth data lines DL1 to DL6. Each of the switch units 262 includes five control switches arranged in parallel. Each of the switch units 262 includes five control switches receiving control signals different from control signals transmitted to distribution switch connected to the corresponding data line.

The first distribution switch SW21 receiving the first control signal CLA is connected to an end of the first data line DL1. Accordingly, the switch unit 262 connected to the other end of the first data line DL1 includes the second to sixth control switches SW32 to SW36 connected to the second to sixth control lines 122 to 126 that respectively receive the second to sixth control signals CLB to CLF. The second to sixth control switches SW32 to SW36 are between the first data line DL1 and the black signal input line 131. The second control switch SW32 is turned on by the second control signal CLB transmitted by the second control line 122 and transmits the black signal BD to the first data line DL1. The third control switch SW33 is turned on by the third control signal CLC transmitted by the third control line 123 and transmits the black signal BD to the first data line DL1. The fourth control switch SW34 is turned on by the fourth control signal CLD transmitted by the fourth control line 124 and transmits the black signal BD to the first data line DL1. The fifth control switch SW35 is turned on by the fifth control signal CLE transmitted by the fifth control line 125 and transmits the black signal BD to the first data line DL1. The sixth control switch SW36 is turned on by the sixth control signal CLF transmitted by the sixth control line 126 and transmits the black signal BD to the first data line DL1.

The second distribution switch SW22 receiving the second control signal CLB is connected to an end of the second data line DL2. Accordingly, the switch unit 262 connected to the other end of the second data line DL2 includes the first control switch SW31 and the third to sixth control switches SW32 to SW36 connected to the first control line 121 and the third to sixth control lines 123 to 126 that respectively receive the first control signal CLA and the third to sixth control signals CLC to CLF. The first control switch SW31 and the third to sixth control switches SW33 to SW36 are between the second data line DL2 and the black signal input line 131. The first control switch SW31 is turned on by the first control signal CLA transmitted by the first control line 121 and transmits the black signal BD to the second data line DL2. The third control switch SW33 is turned on by the third control signal CLC transmitted by the third control line 123 and transmits the black signal BD to the second data line DL2. The fourth control switch SW34 is turned on by the fourth control signal CLD transmitted by the fourth control line 124 and transmits the black signal BD to the second data line DL2. The fifth control switch SW35 is turned on by the fifth control signal CLE transmitted by the fifth control line 125 and transmits the black signal BD to the second data line DL2. The sixth control switch SW36 is turned on by the sixth control signal CLF transmitted by sixth control line 126 and transmits the black signal BD to the second data line DL2.

The third distribution switch SW23 receiving the third control signal CLC is connected to an end of the third data line DL3. Accordingly, the switch unit 262 connected to the other end of the third data line DL3 includes the first control switch SW31, the second control switch SW32, and the fourth to sixth control switches SW34 to SW36 connected to the first control line 121, the second control line 122, and the fourth to sixth control lines 124 to 126 that respectively receive the first control signal CLA, the second control signal CLB, and the fourth to sixth control signals CLD to CLF. The first control switch SW31, the second control switch SW32, and the fourth to sixth control switches SW34 to SW36 are between the third data line DL3 and the black signal input line 131. The first control switch SW31 is turned on by the first control signal CLA transmitted by the first control line 121 and transmits the black signal BD to the third data line DL3. The second control switch SW32 is turned on by the second control signal CLB transmitted by the second control line 122 and transmits the black signal BD to the third data line DL3. The fourth control switch SW34 is turned on by the fourth control signal CLD transmitted by the fourth control line 124 and transmits the black signal BD to the third data line DL3. The fifth control switch SW35 is turned on by the fifth control signal CLE transmitted by the fifth control line 125 and transmits the black signal BD to the third data line DL3. The sixth control switch SW36 is turned on by the sixth control signal CLF transmitted by the sixth control line 126 and transmits the black signal BD to the third data line DL3.

The fourth distribution switch SW24 receiving the fourth control signal CLD is connected to an end of the fourth data line DL4. Accordingly, the switch unit 262 connected to the other end of the fourth data line DL4 includes the first to third control switches SW31 to SW33, the fifth control switch SW35, and the sixth control switch SW36 connected to the first to third control lines 121 to 123, the fifth control line 125, and the sixth control line 126 that respectively receive the first to third control signals CLA to CLC, the fifth control signal CLE, and the sixth control signal CLF. The first to third control switches SW31 to SW33, the fifth control switch SW35, and the sixth control switch SW36 are disposed between the fourth data line DL4 and the black signal input line 131. The first control switch SW31 is turned on by the first control signal CLA transmitted by the first control line 121 and transmits the black signal BD to the fourth data line DL4. The second control switch SW32 is turned on by the second control signal CLB transmitted by the second control line 122 and transmits the black signal BD to the fourth data line DL4. The third control switch SW33 is turned on by the third control signal CLC transmitted by the third control line 123 and transmits the black signal BD to the fourth data line DL4. The fifth control switch SW35 is turned on by the fifth control signal CLE transmitted by the fifth control line 125 and transmits the black signal BD to the fourth data line DL4. The sixth control switch SW36 is turned on by the sixth control signal CLF transmitted by the sixth control line 126 and transmits the black signal BD to the fourth data line DL4.

The fifth distribution switch SW25 receiving the fifth control signal CLE is connected to an end of the fifth data line DL5. Accordingly, the switch unit 262 connected to the other end of the fifth data line DL5 includes the first to fourth control switches SW31 to SW34 and the sixth control switch SW36 connected to the first to fourth control lines 121 to 124 and the sixth control line 126 that respectively receive the first to fourth control signals CLA to CLD and the sixth control signal CLF. The first to fourth control switches SW31 to SW34 and the sixth control switch SW36 are between the fifth data line DL5 and the black signal input line 131. The first control switch SW31 is turned on by the first control signal CLA transmitted by the first control line 121 and transmits the black signal BD to the fifth data line DL5. The second control switch SW32 is turned on by the second control signal CLB transmitted by the second control line 122 and transmits the black signal BD to the fifth data line DL5. The third control switch SW33 is turned on by the third control signal CLC transmitted by the third control line 123 and transmits the black signal BD to the fifth data line DL5. The fourth control switch SW34 is turned on by the fourth control signal CLD transmitted by the fourth control line 124 and transmits the black signal BD to the fifth data line DL5. The sixth control switch SW36 is turned on by the sixth control signal CLF transmitted by the sixth control line 126 and transmits the black signal BD to the fifth data line DL5.

The sixth distribution switch SW26 receiving the sixth control signal CLF is connected to an end of the sixth data line DL6. Accordingly, the switch unit 262 connected to the other end of the sixth data line DL6 includes the first to fifth control switches SW31 to SW35 connected to the first to fifth control lines 121 to 125 that respectively receive the first to fifth control signals CLA to CLE. The first to fifth control switches SW31 to SW35 are between the sixth data line DL6 and the black signal input line 131. The first control switch SW31 is turned on by the first control signal CLA transmitted by the first control line 121 and transmits the black signal BD to the sixth data line DL6. The second control switch SW32 is turned on by the second control signal CLB transmitted by the second control line 122 and transmits the black signal BD to the sixth data line DL6. The third control switch SW33 is turned on by the third control signal CLC transmitted by the third control line 123 and transmits the black signal BD to the sixth data line DL6. The fourth control switch SW34 is turned on by the fourth control signal CLD transmitted by the fourth control line 124 and transmits the black signal BD to the sixth data line DL6. The fifth control switch SW35 is turned on by the fifth control signal CLE transmitted by the fifth control line 125 and transmits the black signal BD to the sixth data line DL6.

An embodiment of a method for driving the display apparatus 200 of FIG. 6 will be described with reference to FIGS. 2, 7B, and 8. The method to be described may be applied to FIG. 7A.

Each of the first to sixth data lines DL1 to DL6 of FIG. 7B is connected to the pixel PX of FIG. 2. First color pixels emitting a first color of light are connected to the first data line DL1 and the fourth data line DL4, second color pixels emitting a second color of light are connected to the second data line DL2 and the fifth data line DL5, and third color pixels emitting a third color of light are connected to the third data line DL3 and the sixth data line DL6.

One frame includes six sub frames. When the first scan signal S[n] is transmitted to pixels in each sub frame via the scan line, data signals are transmitted to each data line via a distribution switch during one of the sub frames. Black signals BDs are transmitted to each data line via a control switch during the remaining sub frames. During each sub frame, a timing at which the first scan signal S[n] is transmitted overlaps a timing at which control signals are transmitted. The data signals are transmitted to the data line corresponding to a distribution switch that is turned on by the control signal. The black signal BD is transmitted to the data line corresponding to a control switch that is turned on by the control signal.

In each sub frame, the pixels PXs are driven during first to fourth periods (AA to DD). Hereinafter, a first sub frame will be mainly described, and the descriptions of the first sub frame may be identically applied to second to sixth sub frames.

In the first sub frame, a timing at which the first scanning signal S[n] is transmitted overlaps a timing at which the first control signal CLA is transmitted. The data signals DATA are transmitted to pixels PXs connected to the first data line DL1, and the black signal BD is transmitted to pixels PXs connected to the second to sixth data lines DL2 to DL6.

For example, in the first period AA, a gate electrode of a first transistor T1 is initialized. The first transistor T1 is included in each of the pixels PX that are connected to the first to sixth data lines DL1 to DL6 and are arranged in the same row. Each pixel PX receives the second scan signal S[n−1] having a gate-on voltage (e.g., a low level) via the second scan line 12, and the fourth transistor T4 is turned on in accordance with the reception of the second scan signal S[n−1]. An initial voltage Vinit is transmitted to the gate electrode of the first transistor T1 via the fourth transistor T4, and the gate electrode of the first transistor T1 and a capacitor Cst are initialized.

During the second period BB, data signals DATA are transmitted to each pixel PX. Each pixel PX receives the first scan signal S[n] having a gate-on voltage (a low level) via the first scan line 10, and the second transistor T2 and the third transistor T3 are turned on in accordance with the reception of the first scan signal S[n]. The first control signal CLA, from among the first to sixth control signals CLA to CLF, is transmitted to the first control line 121 at the same timing as the timing at which the first scan signal S[n] is transmitted. Therefore, the first distribution switch SW21 of the first data line DL1 is turned on, and the data signals DATA transmitted to the first output line OL1 are transmitted to the first data line DL1 via the first distribution switch SW21. Then, the transmitted data signals DATA are transmitted to the first node N1 via the second transistor T2. The first transistor T1 is diode-connected by the third transistor T3, which is turned on, and then is biased in a forward direction. A compensation voltage DATA+Vth (Vth is a negative (−) value), which is decreased by a threshold voltage Vth of the first transistor T1, is applied to the gate electrode of the first transistor T1. A first power voltage ELVDD and the compensation voltage DATA+Vth are applied to both ends of the capacitor Cst, and electric charges, which correspond to a voltage difference between the ends of the capacitor Cst, are stored in the capacitor Cst.

Also, the first control switches SW31 connected to the second to sixth data lines DL2 to DL6 are turned on by the first control signal CLA. The black signal BD is transmitted to the second to sixth data lines DL2 to DL6 via the first control switches SW31 that are turned on. The second transistors T2 are turned on by the first scan signal S[n] in the pixels PXs connected to the second to sixth data lines DL2 to DL6. Therefore, the black signal BD is transmitted to each of the first nodes N1 via the second transistors T2 that are turned on and are included in the pixels PXs connected to the second to sixth data lines DL2 to DL6.

Since the second transistors T2 included in the pixels PXs, which are arranged in the same row, are turned on by the first scan signal S[n], a voltage of the first node N1 of each of the pixels PXs connected to the second to sixth data lines DL2 to DL6 is changed to have a value corresponding to a data signal DATA of a previous frame. Thus, an image having an undesired brightness may be displayed. In the present exemplary embodiment, the black signal BD may be transmitted to pixels PX to which the data signals DATA are not transmitted. Thus, an image having a desired brightness may be displayed.

During the third period CC, the anode of the OLED of each pixel PX is initialized. Each pixel PX receives the third scan signal S[n+1] having a gate-on voltage (a low level) via the third scan line 14, and the seventh transistor T7 is turned on in accordance with the reception of the third scan signal S[n+1]. A voltage of the anode of the OLED is initialized to the initial voltage Vinit via the seventh transistor T7.

During the fourth period DD, the OLED of each pixel PX emits light. A voltage of the emission control signal E[n] is changed from the gate-off voltage (a high level) to a gate-on voltage (a low level) via the emission control line 20 of each pixel PX. Thus, the fifth transistor T5 and the sixth transistor T6 are turned on. A current corresponding to a difference between the voltage of the gate electrode of the first transistor T1 and the first power voltage ELVDD flows, and the current is applied to the OLED via the sixth transistor T6. The pixels PXs connected to the first data line DL1 emit light in correspondence to the data signals DATA. The pixels PXs connected to the second to sixth data lines DL2 to DL6 display black.

In the second sub frame, the timing at which the first scan signal S[n] is transmitted overlaps the timing at which the second control signal CLB is transmitted. The data signals DATA are transmitted to the pixels PX connected to the second data line DL2, and the black signal BD is transmitted to the pixels PX connected to the first data line DL1 and the third to sixth data lines DL3 to DL6.

In the third sub frame, the timing at which the first scan signal S[n] is transmitted overlaps the timing at which the third control signal CLC is transmitted. The data signals DATA are transmitted to the pixels PX connected to the third data line DL3, and the black signal BD is transmitted to the pixels PX connected to the first data line DL1, the second data line DL2, and the fourth to sixth data lines DL4 to DL6.

In the fourth sub frame, the timing at which the first scan signal S[n] is transmitted overlaps the timing at which the fourth control signal CLD is transmitted. The data signals DATA are transmitted to the pixels PX connected to the fourth data line DL4. The black signal BD is transmitted to the pixels PX connected to the first to third data lines DL1 to DL3, the fifth data line DL5, and the sixth data line DL6.

In the fifth sub frame, the timing at which the first scan signal S[n] is transmitted overlaps the timing at which the fifth control signal CLE is transmitted. The data signals DATA are transmitted to the pixels PX connected to the fifth data line DL5. The black signal BD is transmitted to the pixels PX connected to the first to fourth data lines DL1 to DL4, and the sixth data line DL6.

In the sixth sub frame, the timing at which the first scan signal S[n] is transmitted overlaps the timing at which the sixth control signal CLF is transmitted. The data signals DATA are transmitted to the pixels PX connected to the sixth data line DL6. The black signal BD is transmitted to the pixels PX connected to the first to fifth data lines DL1 to DL5.

Referring to FIG. 8, the anode of the OLED is initialized during the third period CC. In another embodiment, the anode may be initialized during the first period AA or second period BB that overlaps the third period CC. Also, the lengths of the first to fourth periods AA to DD may be different in another embodiment.

In accordance with one or more of the aforementioned embodiments, the number of output lines in the display apparatus may be reduced because the data signals, which are transmitted to one output line, are transmitted to i data lines. As a result, manufacturing costs may be decreased. Also, the data signals are transmitted to the pixels PXs without pre-charging the data lines. This may be accomplished by overlapping the scanning signals and the control signals of the de-multiplexers. As a result, brightness deviation may be reduced or prevented.

Also, a black signal may be transmitted to pixels connected to columns different from columns to which the data signals are transmitted in sub frames. Thus, the likelihood that an undesired image will be displayed due to data signals of a previous frame may be reduced.

In one embodiment, the first color pixel may be a red-color pixel, the second color pixel may be a green-color pixel, and the third color pixel may be a blue-color pixel. In another embodiment, a color pixel may be one of a red-color pixel, a green-color pixel, a blue-color pixel, and a white-color pixel or may be a color pixel having another color.

In one embodiment, the switches may be p-channel metal oxide semiconductor (PMOS) type transistors. In another embodiment, the switches may be n-channel MOS (NMOS) type transistors or may be a combination of different types of transistors. Also the types of transistors levels of signals used to turn on/off transistors may be different.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display apparatus, comprising:

a plurality of data lines;

a de-multiplexer including a plurality of first switches, the first switches connected to the data lines; and a plurality of switching circuits connected to the data lines, each of the switching circuits including a plurality of second switches connected to each other in parallel, wherein when one of the first switches connected to a corresponding data line is turned on, one of the second switches of each of the switching circuits except for one of the switching circuits connected to the corresponding data line, is turned on.

2. The display apparatus as claimed in claim 1, wherein a number of the second switches in each of the switching circuits is less than a number of the first switches in the de-multiplexer.

3. The display apparatus as claimed in claim 1, further comprising:

a data driver connected to an output line, wherein the data driver is to transmit data signals to the output line connected to the de-multiplexer.

4. The display apparatus as claimed in claim 1, further comprising:

a plurality of control lines connected to the first switches and the second switches.

5. The display apparatus as claimed in claim 4, wherein the second switches of the one of the switching circuits connected to the corresponding data line are connected to the control lines except for one of the control lines connected to the one of the first switches connected to the corresponding data line.

6. The display apparatus as claimed in claim 5, further comprising:

a scan driver connected to a plurality of scan lines; and a plurality of pixels connected to the scan lines and the data lines, wherein the scan driver is to transmit scan signals to the scan lines that overlap control signals to be transmitted to the control lines.

7. The display apparatus as claimed in claim 6, wherein data signals are transmitted to the pixels via the first switches turned on by the control signals and a black signal is to be transmitted to the pixels via the second switches of each of the switching circuits turned on by the control signals.

8. The display apparatus as claimed in claim 1, wherein:

the first switches in the de-multiplexer are to be turned on in a predetermined order.

9. The display apparatus as claimed in claim 8, further comprising:

a scan driver connected to a plurality of scan lines; and a plurality of pixels connected to the scan lines and the data lines, wherein the scan driver is to transmit scan signals to the scan lines to overlap control signals to be transmitted to the control lines.

10. A display apparatus, comprising:

a pixel connected to a scan line and a data line;

a first switch connected to the data line;

a plurality of second switches connected to each other in parallel and connected to the data line;

a data driver to transmit a data signal to the pixel connected to the data line via the first switch in one of a plurality of sub frames in a frame; and a scan driver to repeatedly transmit a scan signal to the pixel connected to the scan line by each of the plurality of sub frames in the frame, wherein the first switch is turned on and all of the second switches are turned off when the scan signal is transmitted to the pixel in the one of the sub frames, and wherein one of the second switches is turned on when the scan signal is transmitted to the pixel in remaining ones of the sub frames.

11. The display apparatus as claimed in claim 10, wherein:

the first switch is to transmit the data signal to the pixel via the data line, and the second switches are to transmit a black signal to the pixel via the data line.

12. The display apparatus as claimed in claim 10, further comprising a plurality of control lines connected to the first switch and the second switches.

13. The display apparatus as claimed in claim 12, wherein a control signal is to overlap the scan signal in each sub frame and is to be transmitted to one of the control lines.

14. A method for driving a display apparatus, the method comprising:

transmitting repeatedly a first scan signal to pixels connected to a scan line by each of a plurality of sub frames in a frame, each of the pixels connected to a corresponding one of a plurality of data lines;

transmitting a data signal to one of the pixels through a corresponding data line when the first scan signal is transmitted to the pixels in one of the sub frames in the frame; and transmitting a black signal to the one of the pixels through the corresponding data line when the first scan signal is transmitted to the pixels in remaining ones of the sub frames, wherein during the data signal is transmitted to the one of the pixels, the black signal is transmitted to remaining ones of the pixels through corresponding data lines.

15. The method as claimed in claim 14, wherein each of the data lines is connected to one of a plurality of first switches in one end and to a plurality of second switches in another end, and wherein transmitting the data signal includes transmitting the data signal to the one of the pixels through one of the first switches turned on by a control signal.

16. The method as claimed in claim 15, wherein the control signal overlaps the first scan signal.

17. The method as claimed in claim 14, wherein each of the data lines is connected to one of a plurality of first switches in one end and to a plurality of second switches in another end, and wherein transmitting the black signal includes transmitting the black signal to the one of the pixels through the second switches turned on by control signals in a predetermined order.

18. The method as claimed in claim 17, wherein the control signal overlaps the first scan signal.

19. The method as claimed in claim 14, further comprising:

transmitting a second scan signal to the pixels in each sub frame;

and transmitting initialization signal to the pixels in synchronization with the second scan signal.

* * * * *